United States Patent [19]

Zadiraka

[11] Patent Number: 4,540,129

[45] Date of Patent: Sep. 10, 1985

[54] PULVERIZER CONTROL SYSTEM

[75] Inventor: Allan J. Zadiraka, Akron, Ohio

[73] Assignee: The Babcock & Wilcox Company, New Orleans, La.

[21] Appl. No.: 440,909

[22] Filed: Nov. 12, 1982

[51] Int. Cl.[3] ..... B02C 25/00

[52] U.S. Cl. ..... 241/34; 241/30; 241/33

[58] Field of Search ..... 241/30, 34, 35, 36, 241/79.1, 33

[56] References Cited

U.S. PATENT DOCUMENTS 3,856,214 12/1974 Kaltenbach et al. ..... 241/34
3,856,217 12/1974 Brewer ..... 241/79.1

FOREIGN PATENT DOCUMENTS 374098 7/1973 U.S.S.R. ..... 241/30
701708 12/1979 U.S.S.R. ..... 241/30
844057 7/1981 U.S.S.R. ..... 241/34

*Primary Examiner*—Mark Rosenbaum
*Assistant Examiner*—Joseph M. Gorski
*Attorney, Agent, or Firm*—Vytas R. Matas; Robert J. Edwards

[57] ABSTRACT

A pulverizer control system for controlling primary air flow and coal feeder speed to a coal pulverizer comprises a feeder controller for controlling the feeder speed, a feeder speed transmitter for sensing the feeder speed, a primary air flow controller for controlling the primary air flow to the pulverizer and a flow transmitter for sensing the primary air flow. A pulverized coal flow estimator is connected to the transmitters for calculating a coal flow rate which is compared in a first comparator with a demand signal for generating a first error signal. The first error signal is processed in a proportional plus integral unit to obtain a first pulverizer demand signal which is again compared in a second comparator with the calculated coal flow rate to obtain a second demand signal. The second demand signal is utilized to control the feeder controller. An additional comparator is connected to the flow transmitter and the second proportional plus integral unit to establish an air flow demand signal which is utilized to control the air flow controller. An energy correction unit is connected at the output of the estimator to convert the calculated coal flow rate to an energy flow rate which is compatible with the demand signal.

6 Claims, 8 Drawing Figures

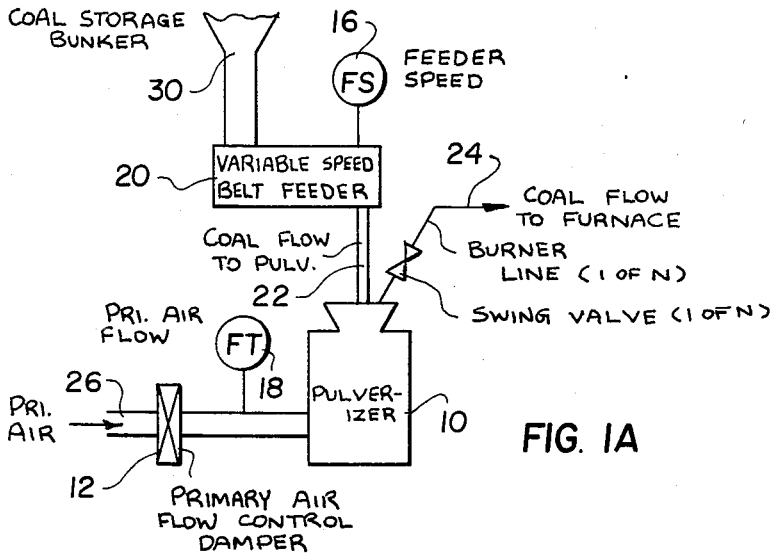
FIG. 1A
FIG. 1B
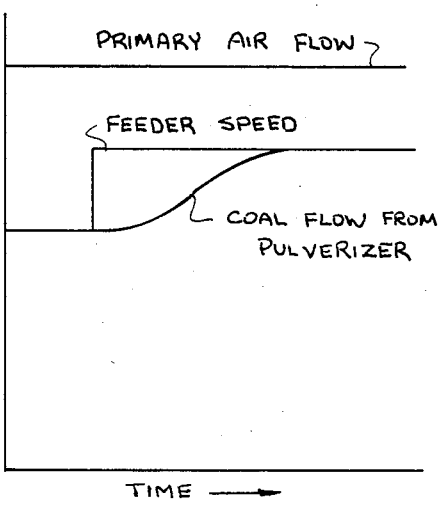
FIG. 1C
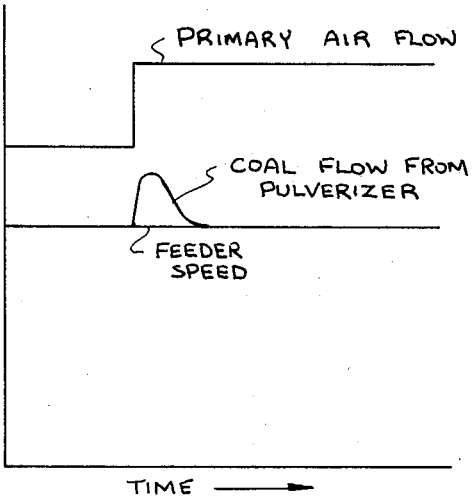

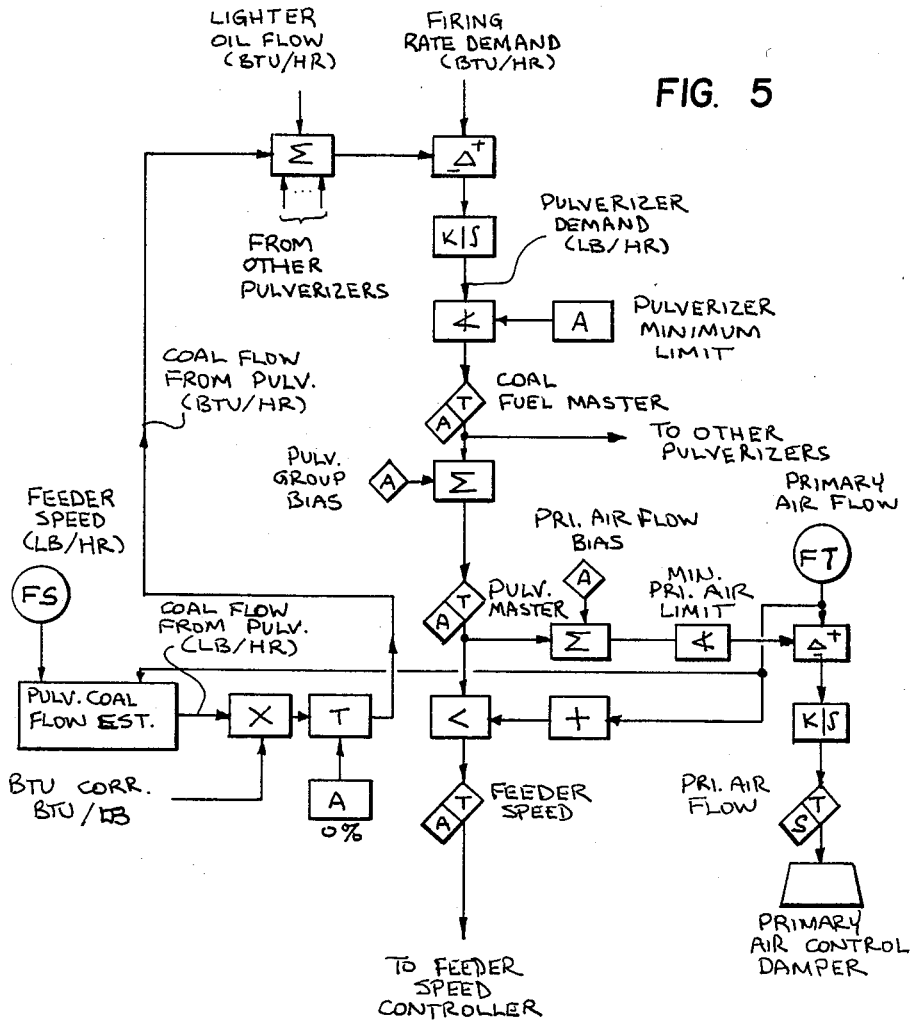
LIGHTER OIL FLOW (BTU/HR)
FIRING RATE DEMAND (BTU/HR)
FIG. 5
FROM OTHER PULVERIZERS
PULVERIZER DEMAND (LB/HR)
PULVERIZER MINIMUM LIMIT
COAL FLOW FROM PULV. (BTU/HR)
COAL FUEL MASTER
TO OTHER PULVERIZERS
PULV. GROUP BIAS
FEEDER SPEED (LB/HR)
PRIMARY AIR FLOW
PRI. AIR FLOW BIAS
PULV. MASTER
MIN. PRI. AIR LIMIT
COAL FLOW FROM PULV. (LB/HR)
PULV. COAL FLOW EST.
BTU CORR. BTU/LB
0%
FEEDER SPEED
PRI. AIR FLOW
PRIMARY AIR CONTROL DAMPER
TO FEEDER SPEED CONTROLLER

PULVERIZER CONTROL SYSTEM

FIELD AND BACKGROUND OF THE INVENTION

The present invention relates in general to coal pulverizer controls for pulverizing coal to be used in a burner, and in particular to a new and useful control system for coal pulverizers which utilizes a calculated value for coal flowing out of the pulverizer as a function of the amount of coal known to be flowing into the pulverizer.

Coal flow to the pulverizer is controlled by varying the position of the primary air flow control damper. The coal-air mixture from the pulverizer splits into a number of burner lines (typically 8) as it leaves the pulverizer. Within the pulverizer there is a recirculating amount of coal which serves to improve drying and sizing classification of the pulverized coal particles.

The storage or recirculating load in a pulverizer varies with the grindability of the coal, the coal flow rate into the pulverizer and the primary air flow. When one or more of these variables change, the coal flow from the pulverizer will differ from the coal flow entering the pulverizer until the storage load readjusts to that required under the new conditions.

Total fuel flow to the furnace is normally controlled as a function of the summation of the feeder speeds which are calibrated from pounds of coal per feeder revolution and BTU per pound of coal which gives an indication of BTU/hour of fuel input to the furnace. Since the BTU per pound of coal may vary, a dynamic BTU correction is often applied. This dynamic BTU correction is normally developed as the integral of other steady-state throttle pressure error.

Since it is recognized that coal flow into the pulverizers does not match coal flow to the furnace except when steady-state conditions have been achieved, a variety of techniques have been utilized to second guess the pulverizer response and compensate the feeder speed back to the fuel flow control to reduce boiler upsets due to changes in fuel flow.

When starting a pulverizer, coal flow to the furnace does not immediately occur when the feeder is started. A time delay in combination with a time lag is used on introducing feeder speed into the fuel totalization circuit, therefore, according to one of these techniques.

When shutting a pulverizer down, coal flow from the pulverizer does not immediately stop when the feeder is stopped. A time lag in combination with a time delay is used to hold a value of fuel flow in the fuel totalization circuit for a period of time after the feeder is stopped unless the swing valves go closed, according to another technique.

In a further scheme, time delays and functions of equipment status are used to determine when coal flow should be expected during start-up or shutdown and to estimate when a pulverizer is clean or empty during a shutdown. Also time lags are applied on feeder speed to compensate for the pulverizer response on load changes.

In a still further scheme derivative action is used on feeder speed and primary air flow to shorten the time for pulverizer storage to reach its new value on load changes by over/under feeding the pulverizer.

Some work has also been done on developing means to measure actual coal flow from the pulverizer but no equipment appears to be available at this time. Several problems which appear to limit the application of such coal flow measurement means are:

(a) the low density of coal in the burner lines;

(b) the large number of measurements which would be required since each burner line would have to be measured; and (c) the existing environmental conditions would tend to make sensors used for such measurements, high maintenance items.

SUMMARY OF THE INVENTION

The pulverizer control system of the present invention is designed to provide improved pulverizer response and has the potential to simplify the overall pulverizer control (modulating and burner) by allowing the use of a calculated value from a pulverizer response model of coal flow from each pulverizer.

Accordingly, an object of the invention is to provide a pulverizer control system for controlling primary air flow and coal feeder speed to a pulverizer comprising, a feeder controller for controlling the feeder speed to vary an amount of coal per unit time supplied to the pulverizer, a feeder speed transmitter for sensing the feed speed, a primary air flow controller for controlling the flow of primary air to the pulverizer, a flow transmitter sensing the air flow, a pulverizer coal flow estimator connected to the feeder speed and flow transmitters for calculating a coal flow rate from the pulverizer, an energy correction unit connected to the estimator for converting the coal flow rate into an energy flow rate, a first comparator for receiving the rate demand signal in energy per unit time which is desired of the pulverizer, the first comparator being connected to the energy connection unit to generate a first error signal, a first proportional-plus-integral unit connected to the first comparator for generating a first pulverizer demand signal, a second comparator connected to the first PPI unit and the energy correction unit for generating a second error signal, a second PPI unit connected to said second comparator for generating a second pulverizer demand signal, the second PPI unit connected to the feeder controller for controlling the feeder speed according to the second demand signal, a third comparator connected to the second PPI unit and the flow transmitter for generating a flow error and a third PPI unit for generating an air flow demand signal which is utilized to control the primary air flow through the flow controller.

Another object of the invention is to provide such a control system wherein the pulverized coal flow estimator comprises means for generating an estimated amount of coal supplied through each stage of a multistage pulverizer which are connected in series to generate a final signal corresponding to an amount of coal leaving the final stage of pulverizer, an integral unit connected to said means for integrating the signal corresponding to an amount of coal leaving the last stage of the pulverizer and a multiplication unit connected between the integration unit and the flow transmitter for obtaining a value corresponding to the flow of coal out of the pulverizer.

A still further object of the invention is to provide such a system, and in particular such an estimator wherein a feedback line is connected at least from an output of the multiplier to a comparator for comparing an output of said means with the output of the multiplier to obtain an error signal which is supplied to the integral unit.

Another object of the invention is to provide a pulverizer control system which is simple, in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1A is a schematic representation of a pulverizer circuit including a pulerverizer for pulverizing coal and combining it with primary air flow to be supplied to a burner or furnace;

FIG. 1B is a graph showing the coal flow response out from a pulverizer to a step change in the feeder speed of coal to the pulverizer;

FIG. 1C is a view similar to FIG. 1B showing the coal flow response with a step change in primary air flow to the pulverizer;

FIG. 5 is a block diagram of a simplified control system according to the invention.

DESCRIPTION OF THE PREFERRED EMBODIMENTS

Figure 2:
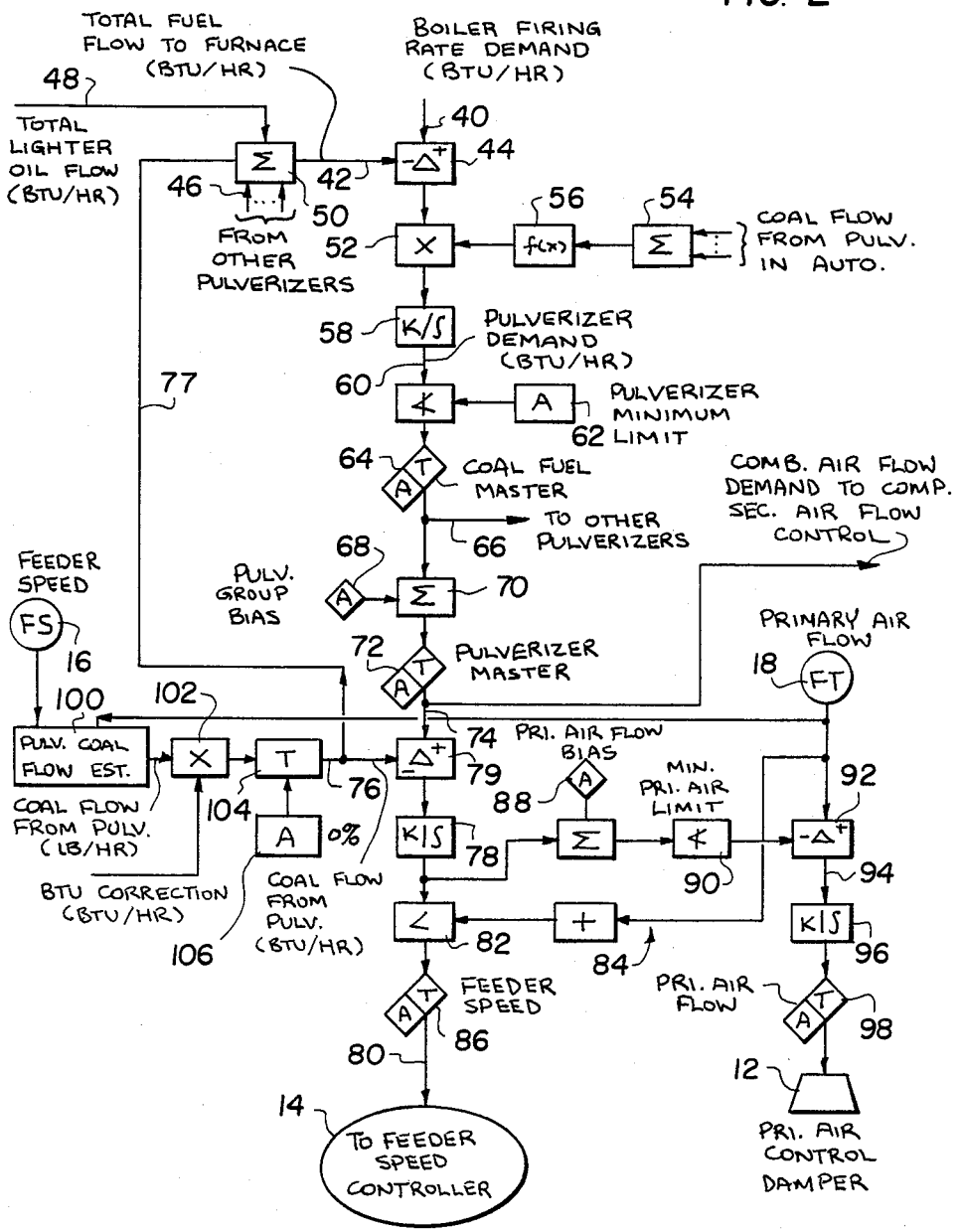
FIG. 2 is a block diagram showing the logic circuitry of the inventive control system.

Referring to the drawings in particular the invention embodied therein comprises a pulverizer control system for a pulverizer shown at 10 in FIG. 1A which is supplied with coal at a variable feeder speed by a feeder 20 over a line 22. Feeder 20 incorporates a feed speed controller 14 shown in FIG. 2 to regulate the speed of coal fed over line 22 to pulverizer 10. Primary air flow is provided over line 26 over a damper 12 to pulverizer 10. The flow rate is sensed by flow transmitter 18. Pulverized coal plus air is supplied over line 24 to a furnace or burner(not shown). A valve on line 24 controls the coal plus air flow rate. A single pulverizer 10 may be provided with several and typically four to ten lines 24 each with their own swing valve.

According to the invention a simplified model of the pulverizer is incorporated into the control system to calculate or estimate the coal flow from the pulverizer and to utilize the estimated coal flow in a feedback control loop over a line 77. FIG. 2 shows the pulverizer control function for a Babcock and Wilcox Co. compartmented windbox system.

The boiler firing rate demand which is in BTU/HR is applied on line 40 and compared with the total fuel flow to the furnace from line 42 to develop the firing rate error in a comparator 44. Total fuel flow to the furnace is a summation of the individual pulverizer coal flows to the furnace at lines 46 and the measured lighter oil flow at line 48, as obtained in summing unit 50. The firing rate error is obtained in multipler 52 as a function of the number of pulverizers which are in automatic as determined in summer 54 and function generator 56, which are responding to the firing rate demand. The firing rate error 1 is applied to the gain-plus-integral unit 58 to establish the pulverizer firing rate demand which is still in BTU/HR at line 60. A minimum pulverizer firing rate limit from unit 62 prevents the pulverizer firing rate demand from being driven to such a low level that unstable pulverizer operation occurs. A coal fuel master selector station 64 allows an operator to manually set the firing rate on all pulverizers operating in automatic. The pulverizer firing rate demand after the coal fuel master 64 is sent in parallel to the individual pulverizers on line 66.

The remaining logic in FIG. 2 is for one pulverizer and is duplicated for the other pulverizers. Logic for the compartment secondary air flow control and coal air temperature control is not shown in FIG. 2 since it is identical to that in the present standard for compartmented windbox systems.

In compartmented windbox systems, combustion air for the burners served by a pulverizer is controlled to match the fuel input from that pulverizer (individual pulverizer air flow control). In non-compartmened windbox systems, combustion air flow is controlled to match the fuel input from all pulverizers, supplying the furnace (total boiler air flow control).

Pulverizer group bias units 68 and 70 allow the operator to manually offset the individual pulverizer firing rate from the common pulverizer demand. A pulverizer master 72 allows the operator to manually control the firing rate on an individual pulverizer. The output of the pulverizer master 72 is used as the combustion air flow demand to the compartment secondary air flow control since the combustion air flow on a compartment is to be controlled to match the BTU/HR input on the compartment.

The individual pulverizer firing rate demand on line 74 is compared in a second comparator 79, with the coal flow from the pulverizer on line 76 with the resulting pulverizer firing rate error applied to a second proportional-plus-integral controller 78. The output of this controller is the demand for feeder speed in pounds of coal per hour at line 80. To prevent a choking of the pulverizer, a cross limit in unit 82 and from a function of primary air flow from assembly 84, is applied to prevent the feeder speed from exceeding the capability of the primary air to remove coal from the pulverizer. A feeder speed selector station 86 allows the feeder speed to be manually controlled.

While the primary air flow is a portion of the combustion air in the burners, its use as the transport medium for the coal requires that the primary air flow be a function of the pounds per hour of coal rather than BTU per hour. The feeder speed demand 78 is therefore used to establish the primary air flow demand. A primary air flow bias at 88 allows the operator to modify the primary air flow demand. A minimum limit at 90 is placed on the primary air flow to ensure sufficient velocity through the burner lines to prevent coal particles from settling out. The primary air flow demand is compared to the measured primary air flow from flow transmitter 18, in comparator 92, with the primary air flow error at 94 applied to a proportional plus integral controller 96 to establish the demand for primary air flow control damper position controlled by controller 12. A primary air flow selector station 98 allows manual control of the primary air flow control damper position.

Measured feeder speed at 16 and primary air flow from 18 are the inputs to the pulverizer coal flow estimator function unit 100. The output of the estimator is the coal flow from the pulverizer in pounds per hour. A BTU correction 102 is applied to the output of the estimator to give the coal flow from the pulverizer in BTU per hour. The coal flow from the pulverizer is transferred at 104 to a zero value from 106 if the swing valves are closed or the primary air flow is stopped, since these conditions immediately stop all coal flow from the pulverizer.

Figure 3A:
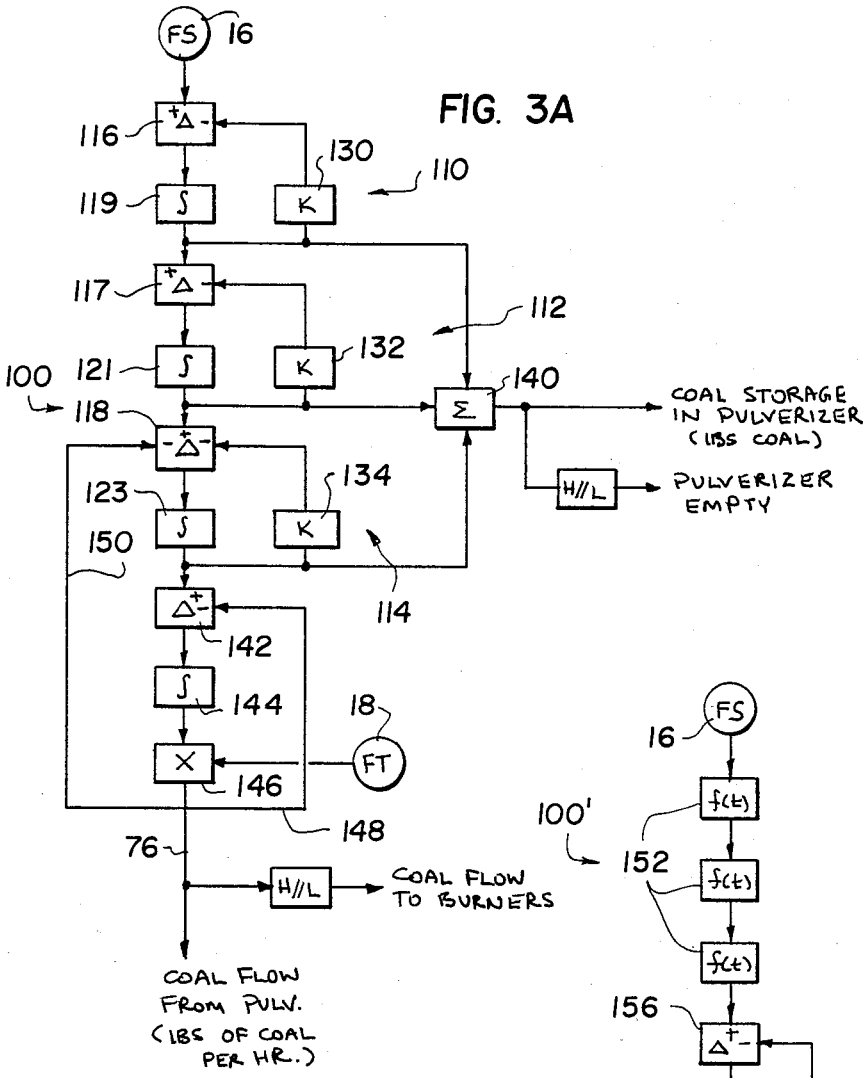
FIG. 3A is a block diagram showing the logic in a coal flow estimator used according to the invention.
Figure 3B:
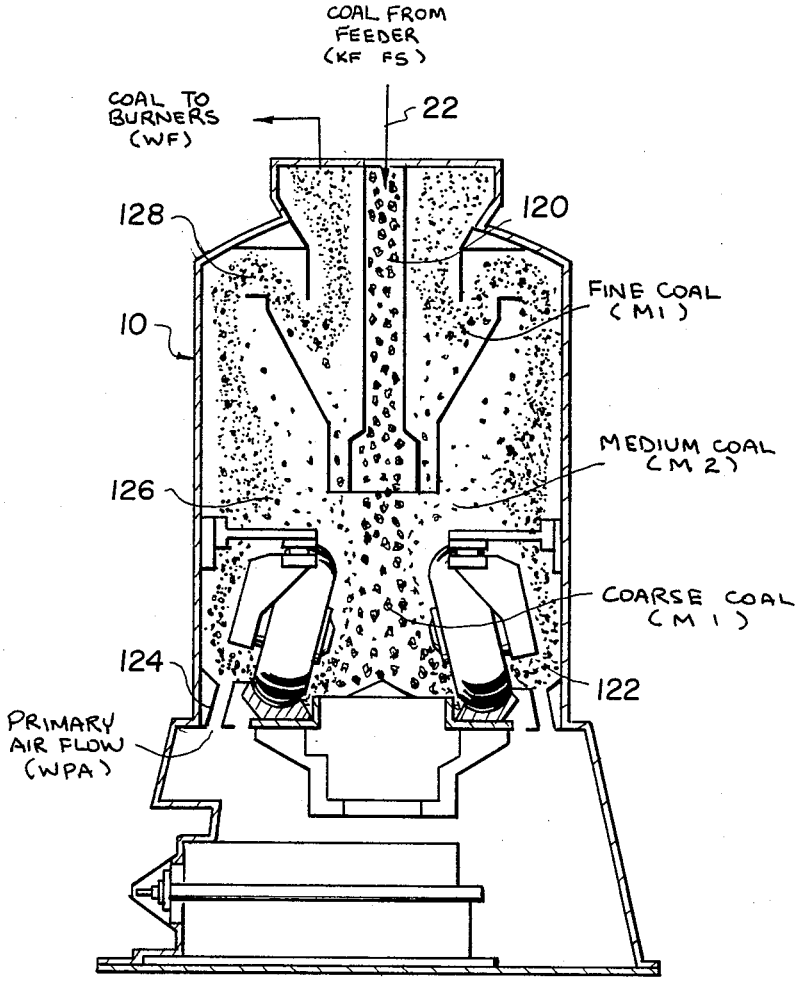
FIG. 3B is a side sectional view of a pulverizer which can be controlled by the inventive control system.

FIG. 3A shows the logic of the pulverizer coal flow estimator 100. The estimator is a simplifed model of the pulverizer response which runs in real time using the measured pulverizer variables of feeder speed and primary air flow as inputs to calculate the dynamic response of the coal flow leaving the pulverizer. FIG. 3B shows a simplified form of a low speed, medium storage pulverizer such as the B & W MPS pulverizer. (For details concerning coal pulverizers see *Steam Its Generator and Use,* 39th Edition, Babcock and Wilcox Co. 1978, pages 9-1 to 9-7.)

The coarse coal from the feeder 22 enters the center 120 of the pulverizer 10, after passing through the grinding zone 122, the coal particles are carried upwardly by high velocity primary air at 124. As the primary air passes upwardly through the large housing, its velocity and carrying ability decrease and the coarser particles fall back into the grinding zone at 126 for further processing. The remaining coal-air mixture goes to the classifier 128 where further rejection of coarser particles occurs.

For simplicity, the estimator model of FIG. 3A assumes a series arrangement of several grinding and classification functions where each stage 110, 112 and 114, receives a uniform sized coal particle and after processing, pass a uniform but smaller sized particle on to the next stage.

The inventive pulverizer control system differs from standard systems in two areas.

1. The total fuel control is based on controlling to the fuel entering the furnace rather than on the fuel entering the pulverizers. This is achieved by calculating the fuel leaving each pulverizer from the measured variables of feeder speed and primary air flow.

2. The feeder speed and primary air flow on each pulverizer are controlled to achieve the desired coal flow from the pulverizer rather than the coal flow into the pulverizer.

Some advantages of the invention follow.

The increasing utilization of PC (Pulverized coal) find units in load following and frequency regulating duty rather than their being base loaded requires increasing emphasis on improving pulverizer response. The increased storage in the larger pulverizers being applied on PC fired boilers has increased the magnitude of the problem. Derivative action is of limited benefit in reducing the problem since they can be tuned properly only for a specific load change at a fixed rate. This inventive control system provides improved pulverizer response by controlling fuel flow into the furnace rather than into the pulverizers. Improved response is also obtained since the proper amount of over/under feeding is controlled to effect faster changes in the mill storage level of the pulverizer.

Starting or stopping a pulverizer has been a problem since the coal flow out of the pulverizer is not known while starting up or shutting down the unit. The invention provides an estimate of the coal flow out of the pulverizer during these periods which will minimize disturbance to the unit when taking a pulverizer in or out of service. This would eliminate the logic now required to minimize the upset occurring during these periods.

Whether a pulverizer is clean or empty has, in the past, been determined by monitoring if either the swing valves are open and the feeder is off for a certain time delay. The inventive control will provide as an output the amount of coal remaining in the pulverizer which can be used to decide when a pulverizer is clean thus allowing a variable length cleaning sequence rather than requiring it be cleaned a sufficient length of time for worst case conditions. This would also indicate when a pulverizer has been tripped with coal remaining and needs to be inerted and/or swirled.

Presently, the trial for main flame ignition is based on a time delay after feeder start. The inventive control can provide an output when sufficient coal is flowing to the burners, to indicate where the coal flame should be detected. This would also cover the case when a pulverizer is being restarted with coal already in the pulverizer if the three mass integrals are tied into memory units so they did not drift to zero when the pulverizer was out of service. These memories would have to be reset to zero if the pulverizer was cleaned out through pyrites hopper while out of service.

Some disadvantages of the invention include the fact that the coal flow out of the pulverizer is a calculated value rather than a measured value and thus can be in error. The model used to provide the estimate could be improved to decrease the error.

The system also requires a number of additional calculations over presently available systems and results in increased complexity. The trend toward microprocessor based controls however, reduces the impact of the increased complexity and the potential elimination of the logic and timers presently used in attempting to compensate for not actually knowing coal flow to the furnace.

The inventive system also would require the estimator and feeder speed demand control loop to be tuned during commissioning of the unit. For a given pulverizer type, the constants for the estimator should repeat from unit to unit. It could eliminate the need for tuning the following:

1. main flame trial for ignition timer;
2. timer for cancelling main flame monitoring on removing a pulverizer from service;
3. pulverizer clean out timer on shutdown;
4. timer and lag for adding feeder speed to fuel totalization circuit on pulverizer start-up;
5. timer and lag for falsifying feeder speed in fuel totalization circuit when feeder is stopped on a pulverizer shutdown;
6. derivative action on feeder speed and primary air flow for load change response; and
7. overfeed function on feeder start used to shorten time until coal reaches burners on placing a pulverizer in service.

Figure 4:
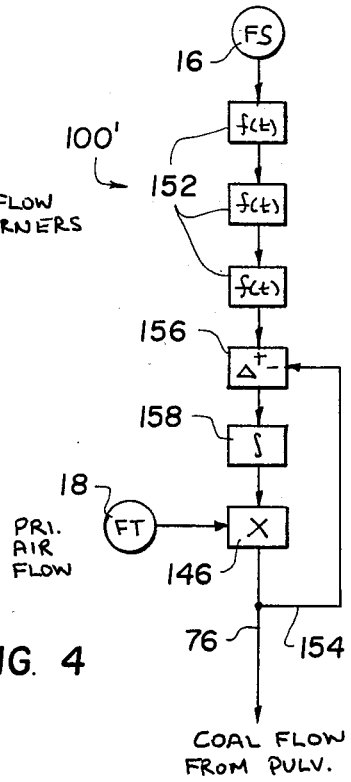
FIG. 4 is a block diagram of a simplified coal flow estimator according to the invention.

FIG. 4 shows a simpler implementation of an estimator which would provide the same benefits in the area of fuel flow control and timing but which would not necessarily provide the required storage function for clean out timing. FIG. 5 shows a possible implementation on a non-compartmented windbox system.

Returning now to FIG. 3A, the estimator of the invention operates as follows. The feeder speed value is supplied from the feeder speed transmitter 16 to a series of comparators 116, 117 and 118 each with an integral unit 119, 121 and 123 thereafter. The comparator correspond to stages 110, 112 and 114 of the pulverizer shown in FIG. 3B at the various zones of the pulverizer 10. Each comparator processes a proportional signal from proportional units 130, 132 and 134 respectively so that, at each stage, a signal proportional to the amount of coal actually leaving that stage is obtained. The output of integral unit 123 thus corresponds to a calculated value of the amount of coal flowing out of the last stage of the pulverizer. The amount of coal in each of the pulverizer stages can be summed in a summing unit 140 to provide a value of the amount of coal in the pulverizer.

A further comparator 142 is connected to the output of integral unit 123 and its input is again integrated in integral unit 144. The output of integral unit 144 is multiplied in multiplication unit 146 by the actual air flow amount provided by transmitter 18 to obtain a calculated coal flow rate on line 76. Feedback lines 148 and 150 are connected from line 76 to comparators 142 and 118 respectively.

In the simplified estimator of FIG. 4, function generators 152 replace the three stage estimation in FIG. 3A. Again a feedback line 154 is provided between output line 76 and a comparator 156 with integration unit 158 provided before multiplication unit 146.

FIG. 5 shows a simplified version of the inventive pulverizer control system utilizing only a single comparator stage rather than the double comparator stage of the embodiment shown in FIG. 2.

While specific embodiments of the invention have been shown and described in detail to illustrate the application of the principles of the invention, it will be understood that the invention may be embodied otherwise without departing from such principles.

What is claimed is:

1. A pulverizer control system for controlling primary air flow and coal feeder speed to a coal pulverizer comprising:

a feeder controller for controlling feeder speed to vary an amount of coal per unit time supplied to the pulverizer;

a feeder speed transmitter for sensing feeder speed;

a primary air flow controller for controlling flow of primary air to the pulverizer;

a flow transmitter for sensing primary air flow;

a pulverizer coal flow estimator connected to said feeder speed and flow transmitters for calculating a coal flow rate from the pulverizer;

an energy correction unit connected to said estimator for converting said coal flow rate to an energy flow rate;

a first comparator for receiving a rate demand signal in energy per unit time which is desired of the pulverizer and connected to said energy correction unit to generate a first error signal;

a first proportional-plus-integral unit connected to said first comparator for generating a first pulverizer demand signal, said first proportional-plus-integral unit connected to said feeder controller for controlling the feeder speed according to said first pulverizer demand signal;

a further comparator connected to said first proportional-plus-integral unit and to said flow transmitter for generating a flow error; and a further proportional-plus-integral unit connected to said further comparator for generating an air flow demand signal, said further proportional-plus-integral unit connected to said flow controller for controling the primary air flow according to said air flow demand signal.

2. A pulverizer control system according to claim 1, including a second comparator connected to said first proportional-plus-integral unit and said energy correction unit for generating a second error signal, a second proportional-plus-integral unit connected to said second comparator for generating a second pulverizer demand signal, said second pulverizer-plus-integral unit connected to said feeder controller for controlling the feeder speed according to said second proportional demand signal, said further comparator connected to said second plus-integral unit and to said flow transmitter for generating the flow error.

3. A pulverizer control system according to claim 2, wherein the pulverizer includes a plurality of stages each for passing coal of ever decreasing grain size, said estimator comprising a plurality of means, equal in number to the plurality of pulverizer stages, connected in series each for generating a signal corresponding to an amount of coal passing out of each stage respectively, a first one of said means connected to a last one of said means in said series, an integral unit connected to an output of said fourth comparator for integrating a signal therefrom, a multiplier connected to an output of said integral unit and connected to said flow transmitter for multiplying primary air flow value by the output of said integral unit to generate the coal flow rate, and a feedback line connected between an output of said multiplier and said fourth comparator.

4. A pulverizer control system according to claim 3, wherein said means comprise a plurality of comparators equal in number to the plurality of pulverizer stages connected in series with an additional integral unit after each additional comparator and a feedback line between an output of each additional integral unit and each preceding comparator with a proportioning in each feedback line, and an additional feedback line between the output of said multiplier and a last additional comparator in said series of comparators.

5. A pulverizer control system according to claim 1, wherein the pulverizer includes a plurality of stages each for passing coal of ever decreasing grain size, said estimator comprising a plurality of means, equal in number to the plurality of pulverizer stages, connected in series each for generating a signal corresponding to an amount of coal passing out of each stage respectively, a first one of said means connected to said feeder speed transmitter, a fourth comparator connected to a last one of said means in said series, an integral unit connected to an output of said fourth comparator for integrating a signal therefrom, a multiplier connected to an output of said integral unit and connected to said flow transmitter for multiplying the primary air flow value by the output of said integral unit to generate the coal flow rate, and a feedback line connected between an output of said multiplier and said fourth comparator.

6. A pulverizer control system according to claim 5, wherein said means comprise a plurality of comparators in a number equal in number to the plurality of pulverizer stages connected in series with an additional integral unit after each additional comparator and a feedback line between an output of each additional integral unit and each preceding comparator with a proportioning in each feedback line, and an additional feedback line between the output of said multiplier and a last additional comparator in said series of comparators.

* * * * *

UNITED STATES PATENT AND TRADEMARK OFFICE

CERTIFICATE OF CORRECTION

PATENT NO. :4,540,129

DATED :9/10/85

INVENTOR(S) :ALLAN J. ZADIRAKA

It is certified that error appears in the above-identified patent and that said Letters Patent are hereby corrected as shown below:

In CLAIM 1 column 8, line 2, change "controling" to --controlling--.

In CLAIM 2, column 8, line 13, cancel "proportional".

In CLAIM 2, column 8, line 15 after "second", insert --proportional- --.

In CLAIM 3, column 8, line 24, after "said means connected to", insert --said feeder speed transmitter, a fourth comparator connected to--.

In CLAIM 3, column 8, line 29, before "output", change "the" to --an--.

In CLAIM 5, column 8, line 43, change "claim 1" to --claim 2--.

In CLAIM 5, column 8, lines 50-52, after "said means connected to", cancel "said feeder speed transmitter, a fourth comparator connected to a last one of said means in said series", and replace with --a last one of said means in said series,--.

In CLAIM 5, column 8, line 56, before "output", change "the" to --an--

UNITED STATES PATENT AND TRADEMARK OFFICE

CERTIFICATE OF CORRECTION

PATENT NO. : 4,540,129

DATED : 9/10/85

INVENTOR(S) : Allan J. Zadiraka

It is certified that error appears in the above-identified patent and that said Letters Patent is hereby corrected as shown below:

In Claim 6, column 8, line 62, before "equal", cancel "in a number".

Signed and Sealed this

Ninth Day of December, 1986

*Attest:*

DONALD J. QUIGG

*Attesting Officer*

*Commissioner of Patents and Trademarks*